US007610201B2

(12) United States Patent
Yamada

(10) Patent No.: US 7,610,201 B2
(45) Date of Patent: Oct. 27, 2009

(54) METHOD AND APPARATUS FOR SYNTHESIZING SPEECH

(75) Inventor: Masayuki Yamada, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 476 days.

(21) Appl. No.: 11/210,629

(22) Filed: Aug. 24, 2005

(65) Prior Publication Data

US 2006/0047514 A1 Mar. 2, 2006

(30) Foreign Application Priority Data

Aug. 26, 2004 (JP) ..... 2004-246813

(51) Int. Cl.
*G10L 13/08* (2006.01)

(52) U.S. Cl. ..... 704/260; 704/258; 704/270

(58) Field of Classification Search ..... 704/270, 704/275, 258, 260, 276, 271, 272
See application file for complete search history.

(56) References Cited

U.S. PATENT DOCUMENTS 7,222,076 B2 * 5/2007 Kobayashi et al. ..... 704/275

FOREIGN PATENT DOCUMENTS

| | | |
|---|---|---|
| JP | 05-300106 | 11/1993 |
| JP | 8-123458 A | 5/1996 |
| JP | 2000-83082 A | 3/2000 |

* cited by examiner

*Primary Examiner*—Huyen X. Vo
(74) *Attorney, Agent, or Firm*—Canon U.S.A., Inc., IP Division

(57) ABSTRACT

A method for synthesizing speech includes an obtaining step of obtaining a speech message, and a resuming step of resuming speech output of the speech message according to resumption data representing a resumption mode of the speech message when the speech output of the speech message is suspended in the middle of synthesizing and outputting the speech based on the speech message.

13 Claims, 6 Drawing Sheets

FIG. 3

801

| PRIORITY | SPEECH MESSAGE | RESUMPTION MODE | SPEECH START POINT | ... |
|---|---|---|---|---|
| 1 | PAPER JAM AT OUTPUT PAPER TRAY | FROM BEGINNING | 0 | ... |
| 3 | NO FAX RECEIVED | FROM SUSPENDED POSITION | 0 | ... |
| 3 | ONE MAIL MESSAGE RECEIVED | FROM SUSPENDED POSITION | 0 | ... |
| ⋮ | ⋮ | ⋮ | ⋮ | ⋱ |

FIG. 4

802

| PRIORITY | SPEECH MESSAGE | RESUMPTION MODE | SPEECH START POINT | SPEECH END POINT | ... |
|---|---|---|---|---|---|
| 1 | PAPER JAM AT OUTPUT PAPER TRAY | FROM BEGINNING | 120 | 140 | ... |

FIG. 5

| MESSAGE TYPE | SPEECH-SYNTHESIZING REQUEST |
|---|---|
| SPEECH MESSAGE | "DOUBLE-SIDED PRINTING HAS BEEN SET" |
| PRIORITY | 2 |
| INTERRUPTION | NO |
| TIME-OUT | 14 : 25 : 50 |
| RESUMPTION MODE | FROM BEGINNING |
| FEEDBACK METHOD | MESSAGE |

METHOD AND APPARATUS FOR SYNTHESIZING SPEECH

BACKGROUND OF THE INVENTION

1. Field of the Invention

The present invention relates to methods and apparatuses for synthesizing speech and providing the synthesized speech to users.

2. Description of the Related Art

Hereto, various types of devices have included a function for synthesizing speech and providing the synthesized speech to users. There are some types of speech synthesis, for example, recorded-speech synthesis that plays back speech recorded in advance and text to speech synthesis that converts text data into speech.

In devices including the speech-synthesizing function described above, more than one type of speech message needs to be simultaneously played back in some cases. For example, in a multifunction device including facsimile and copying functions, when facsimile transmission and a copying operation are simultaneously performed, transmission completion and a paper jam may simultaneously occur. In this case, the following two speech messages may need to be simultaneously output: "Transmission completed" and "Paper jam has occurred".

When more than one speech message is simultaneously synthesized and output, as described above, the clearness of the speech is impaired, thereby impairing operational feeling of users. Thus, speech synthesis has been hereto performed in order of priority, as disclosed in Japanese Patent Laid-Open No. 5-300106. In this arrangement, priorities are assigned to the speech messages, and speech synthesis is performed with a higher priority for a message having a higher priority to output the synthesized speech. That is to say, speech synthesis may be first performed for a message having a higher priority.

In the known method described above, to urgently perform speech output having a higher priority, a control operation may be performed so as to suspend a current speech output having a lower priority by interrupting it and to perform speech output of a message having a higher priority, thereby satisfying detailed user needs. In general, the speech output by speech synthesis can be suspended. Thus, the arrangement described above may be achieved by suspending a speech output having a lower priority, performing speech output having a higher priority, and restarting the speech output having the lower priority. However, depending on the content of the speech message, such an arrangement may confuse users by restarting the speech output from the suspended point. Thus, resumption of the interrupted speech output also needs to be carefully controlled.

SUMMARY OF THE INVENTION

The present invention is conceived in view of the problems described above. The present invention provides a method for specifying speech messages together with respective resumption modes after interrupting and for appropriately controlling the resumption mode of speech output that was interrupted.

Thus, a method for synthesizing speech according to the present invention includes an obtaining step of obtaining a speech message, and a resuming step of resuming speech output of the speech message according to resumption data representing a resumption mode of the speech message when the speech output of the speech message is suspended in the middle of synthesizing and outputting the speech based on the speech message.

Moreover, an apparatus for synthesizing speech according to the present invention includes an obtaining unit configured to obtain a speech message, and a resuming unit configured to resume speech output of the speech message according to resumption data representing a resumption mode of the speech message when the speech output of the speech message is suspended in the middle of synthesizing and outputting the speech based on the speech message.

Further features of the present invention will become apparent from the following description of exemplary embodiments with reference to the attached drawings.

BRIEF DESCRIPTION OF THE DRAWINGS

FIG. 3 is a view showing the data structure of a typical message queue according to the first embodiment.

FIG. 4 is a view showing the data structure of a typical current-message buffer according to the first embodiment.

FIG. 5 is a view showing data included in a typical speech-synthesizing request message according to the first embodiment.

DESCRIPTION OF THE EMBODIMENTS

Next, embodiments according to the present invention are described with reference to the attached drawings.

First Embodiment

Figure 1:
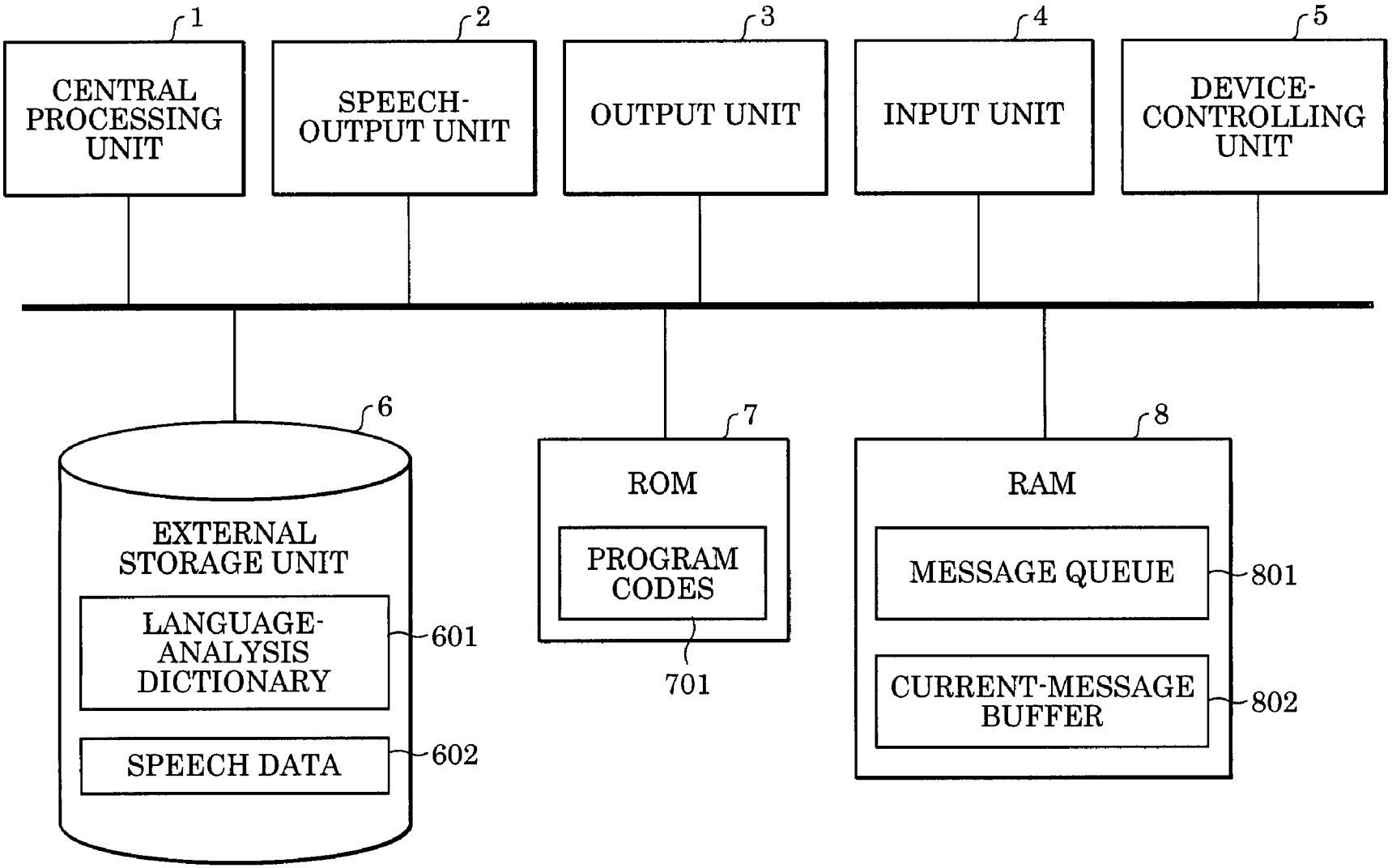
FIG. 1 is a block diagram showing the hardware configuration of a typical information processor according to a first embodiment.

FIG. 1 is a block diagram showing the hardware configuration of a typical information processor according to a first embodiment. In FIG. 1, a central processing unit 1 performs, for example, arithmetic operations and control operations. In particular, the central processing unit 1 performs various types of control operations according to the procedure in the first embodiment. A speech-output unit 2 outputs speech to users. An output unit 3 presents information to users. Typically, the output unit 3 is an image-output unit such as a liquid crystal display. The output unit 3 may also serve as the speech-output unit 2. Alternatively, the output unit 3 may have a simple structure that just flashes a light. An input unit 4 includes, for example, a touch panel, a keyboard, a mouse, and buttons, and is used for users to instruct the information processor to perform an operation. A device-controlling unit 5 controls peripheral devices of the information processor, for example, a scanner and a printer.

An external storage unit 6 includes, for example, a disk unit and a nonvolatile memory, and stores, for example, a language-analysis dictionary 601 and speech data 602 that are used in speech synthesis. Moreover, the external storage unit 6 also stores data to be permanently used, out of various types of data stored in a RAM 8. Moreover, the external storage unit 6 may be a portable storage unit such as a CD-ROM or a memory card, thereby improving convenience.

A ROM 7 is a read-only memory and stores, for example, program codes 701 that perform the speech synthesizing process and other processes according to the first embodiment and fixed data (not shown). The use of the external storage unit 6 and the ROM 7 is optional. For example, the program codes 701 may be installed in the external storage unit 6 instead of the ROM 7. The RAM 8 is a memory that temporarily stores data for a message queue 801 and a current-message buffer 802, other temporary data, and various types of flags. The components described above are connected to a bus.

Figure 2:
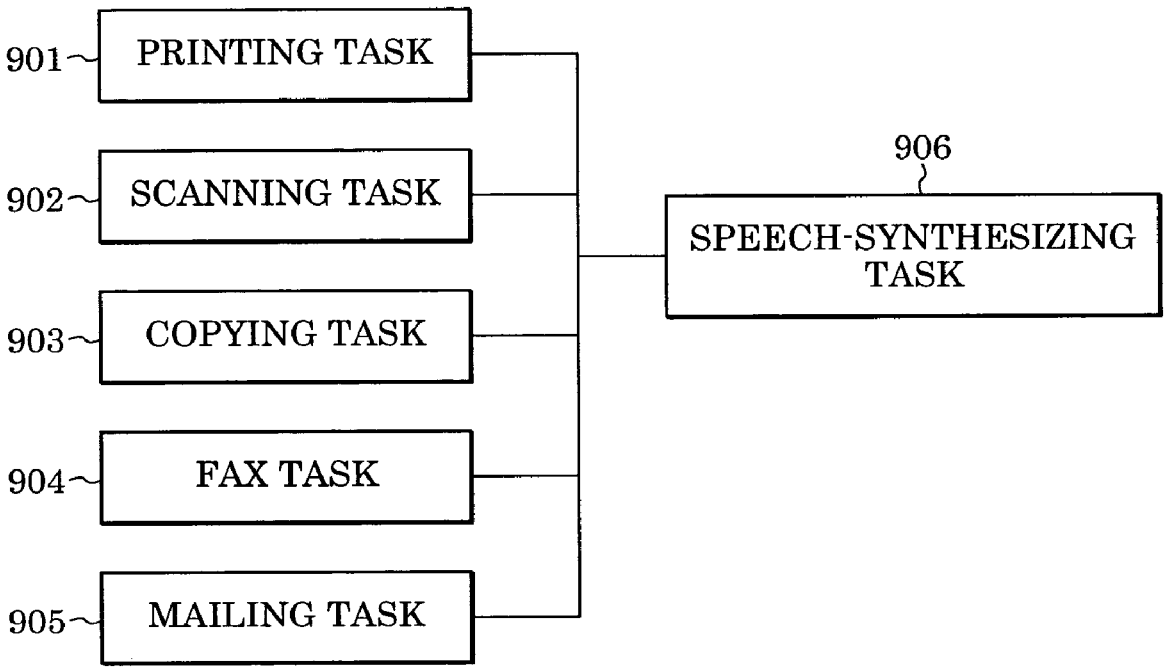
FIG. 2 is block diagram showing the task structure according to the first embodiment.

In the first embodiment, a case where a plurality of functions is performed by multitasking is described, as shown in FIG. 2. For example, a printing function is performed by a printing task 901, and a scanning function is performed by a scanning task 902. These tasks cooperate through inter-task communication (messaging). For example, a copying function that is a combined function is performed by cooperation between a copying task 903, the printing task 901, and the scanning task 902.

In FIG. 2, a speech-synthesizing task 906 receives request messages for synthesizing and outputting speech from the other tasks, and synthesizes and outputs speech. Typical speech synthesis methods are a recorded-speech synthesis method that plays back messages recorded in advance and a text to speech synthesis method that can output flexible messages. Although both of these methods are applicable to the information processor according to the first embodiment, the case of the text to speech synthesis method is described in the first embodiment. In the case of the text to speech synthesis method, text described in a natural language or text described in a description language for speech synthesis is input. Both of these cases are applicable to the first embodiment.

In the speech-synthesizing task 906, speech messages to be output are controlled in the message queue 801. In the message queue 801, speech messages and other related data are arranged in output order. An example of the message queue 801 is shown in FIG. 3. In FIG. 3, "priority" indicates the priority of a speech message, and a speech message having a higher priority is located at a higher position in the message queue 801. "Resumption model" indicates a resumption mode when a speech output is interrupted by another speech output. "Speech start point" indicates a point in a speech message from which speech output is started. "Speech start point" is normally set to the beginning of the speech message, i.e., zero. In some cases, "speech start point" may be set to another point when the speech output is interrupted by another speech output. For example, in a case where the resumption mode of a speech message is set to "from suspended point", when the speech output of the speech message is interrupted by another speech output, "speech start point" is set to the suspended point.

Moreover, in the speech-synthesizing task 906, the message that is currently being output is controlled using the current-message buffer 802. The content of the current-message buffer 802 is substantially the same as that of an entry in the message queue 801. An example of the current-message buffer 802 is shown in FIG. 4. In FIG. 4, "speech end point" indicates the end of data that was output to the speech-output unit 2.

Next, the process of the speech-synthesizing task 906 in the information processor according to the first embodiment is described with reference to a flowchart of FIG. 6.

In step S1, the speech-synthesizing task 906 receives messages from the other tasks. The following messages are sent to the speech-synthesizing task 906: a speech-synthesizing request message for requesting speech synthesis and a speech-output completion message that is sent when the speech-output unit 2 completes outputting a predetermined amount of speech data. The speech-synthesizing request message includes data, for example, a speech message, required for the speech-synthesizing task 906 to perform speech synthesis. Typical data included in the speech-synthesizing request message is shown in FIG. 5.

In FIG. 5, the content of "priority" and "resumption mode" corresponds to the entry in the message queue 801. "Interruption" indicates whether speech output by interrupting is performed. In a case where "interrupt" in a speech-synthesizing request message is set to "YES", when this request message is received during speech output of another message, speech output of the another message is suspended and speech output of a speech message according to this request message is performed. "Time-out" indicates data used for canceling speech output of the corresponding message when this speech output is not performed within a predetermined time. In some cases, when many requests for speech output having a high priority are sent, speech output having a low priority is left in the message queue 801 for a long time and becomes useless information. Thus, "time-out" is useful. In FIG. 5, "time-out" is described as a time-out time. Alternatively, "time-out" may be described as a time allowance for time-out, for example, ten minutes. "Feedback method" indicates a method for sending feedback to the sender of speech-output request after the speech output. "Feedback method" may be "message", "shared variable", "none" (no feedback), and the like.

Turning back to FIG. 6, in step S2, the message type of the message received in step S1 is determined (the speech-synthesizing request message or the speech-output completion message). In the case of the speech-synthesizing request message, the process proceeds to step S3. In the case of the speech-output completion message, the process proceeds to step S13.

In step S3, a position in the message queue 801 for inserting the speech message according to the corresponding speech-synthesizing request is determined, based on the data included in the message received in step S1. For example, when speech output by interrupting is not performed, the speech message is inserted in the message queue 801 as the last entry of a group of speech messages having the same priority as the speech message. Alternatively, in a case where the priority of the speech message is equal to or higher than that of the currently output speech message, when speech output by interrupting is performed, the speech message is inserted in the message queue 801 at the top. In step S4, the speech message and associated data, for example, the resumption mode, are inserted in the message queue 801 at the insert position determined in step S3. In step S5, "speech start point" in the inserted entry is reset to the beginning of the speech message. "Speech start point" is data for specifying the start point of speech synthesis in the speech message and is used when synthesized speech is obtained in, for example, step S18 described below.

In step S6, it is determined whether another speech message is currently being output. When another speech message is currently being output, the process proceeds to step S7 to determine whether speech output by interrupting is to be performed. When another speech message is not currently being output, the process proceeds to step S16 to perform speech output according to the message queue 801.

In step S7, it is determined whether speech output by interrupting is to be performed according to the corresponding speech-synthesizing request, based on the data included in the message received in step S1. In the case where the priority of the speech message is equal to or higher than that of the currently output speech message, when the settings are performed so that speech output by interrupting is to be performed, it is determined that speech output by interrupting is to be performed. When speech output by interrupting is to be performed, the process proceeds to step S8 to suspend the current speech output. On the other hand, when the settings are performed so that speech output by interrupting is not performed, the process goes back to step S1 where speech synthesis is performed under the control of the message queue 801.

When it is determined in step S7 that speech output by interrupting is to be performed, the current speech output is first suspended in step S8. Then, in step S9, data of "resumption mode" of the speech output interrupted in step S8 is read from the message queue 801. In step S10, it is determined whether the data content read in step S9 specifies that the interrupted speech output is to be restarted. When the interrupted speech output is not to be restarted, "resumption mode" shown in FIG. 5 is set to "no resumption" and the determination in step S9 is performed with reference to these settings. When the interrupted speech output is to be restarted, the process proceeds to step S11 to register an entry for restarting the interrupted speech output in the message queue 801. When the interrupted speech output is not to be restarted, the process proceeds to step S16 and the following steps where speech output by interrupting is performed and the content of the current speech output is discarded, i.e., the current speech output is terminated.

In step S11, the content of the current-message buffer 802 is inserted in the message queue 801. The insert position is just after the speech message, for which speech output by interrupting is performed. In step S12, "speech start point" in the entry of the speech message to be restarted, which is inserted in step S11, is set up. When the data of "resumption mode", read in step S9 is "from beginning", "speech start point" is set to the beginning of the speech message to be restarted. That is to say, "speech start point" of the current speech message is set to zero. On the other hand, when the data of "resumption mode" read in step S9 is "from suspended point", "speech start point" is set to the content of "speech start point" in the current-message buffer 802. After the settings for restarting the interrupted speech output (the suspended speech output) are performed as described above, the process proceeds to step S16 where speech of the speech message by interrupting is synthesized and output. Step S16 and the following steps are described below.

Next, a case where the message type is the speech-output completion message in step S2 and the process proceeds to step S13 is described.

In step S13, it is determined whether speech output of the speech message in the current-message buffer 802 is completed. When speech output of the speech message in the current-message buffer 802 is completed, the process proceeds to step S14. When speech output of the speech message in the current-message buffer 802 is not completed, the process proceeds to step S17.

In step S14, the content of the current-message buffer 802 is erased. Then, in step S15, it is determined whether the message queue 801 is empty. When the message queue 801 is not empty, the process proceeds to step S16. When the message queue 801 is empty, the process goes back to step S1.

In step S16, the leading entry in the message queue 801 is retrieved and set to the current-message buffer 802. In a case where a time-out time is set in "time-out" in the retrieved entry, as shown in FIG. 5, when the current time is past the time-out time, this entry is discarded and the next entry is retrieved. When there is no next entry, i.e., the message queue 801 is empty, the process goes back to step S1. Then, in step S17, "speech start point" in the current-message buffer 802 is updated with the value of "speech end point". However, when the entry is retrieved from the message queue 801 for the first time, "speech end point" has no value and thus "speech start point" is not updated in step S17. That is to say, the value of "speech start point" registered in the message queue 801 is used as is. Then, a predetermined amount of synthesized speech that starts from the point specified in "speech start point" in the current-message buffer 802 is obtained in step S18, and the obtained synthesized speech is output to the speech-output unit 2 in step S19. The detailed process for obtaining the synthesized speech in step S18 is described below with reference to a flowchart of FIG. 7. The end point of the output speech is recorded in "speech end point" in the current-message buffer 802. Thus, when the process in step S17 is performed next time, "speech start point" is updated and the portion following the output portion in the synthesized speech is obtained. After the process in step S19, the process goes back to step S1.

Figure 7:
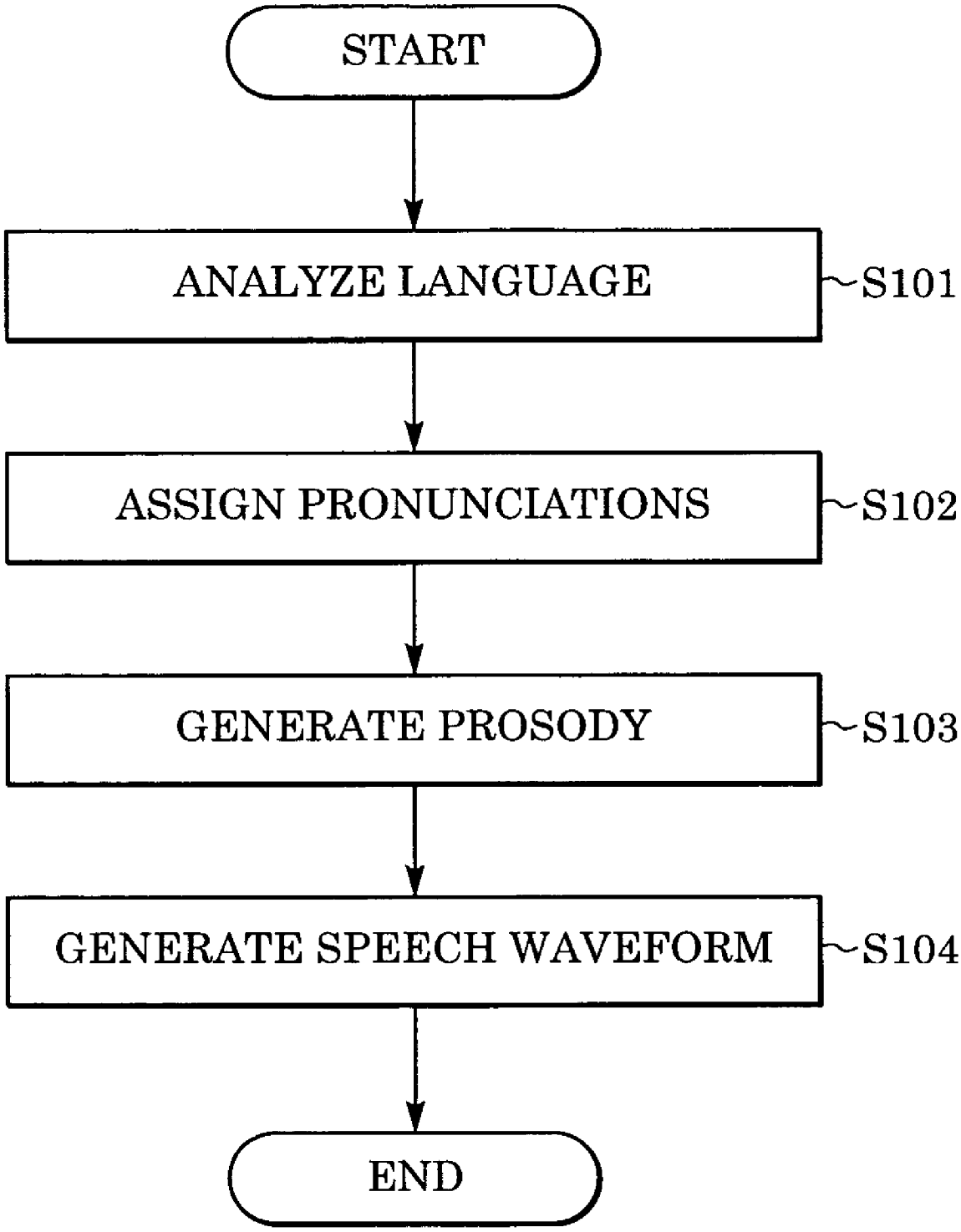
FIG. 7 is a flowchart showing a typical process of text to speech synthesis according to the embodiments.

The process of text to speech synthesis will now be described. FIG. 7 is a flowchart showing a typical process of text to speech synthesis according to the first embodiment. In step S101, language analysis is first performed on the speech message. The process of language analysis includes steps such as morphological analysis and syntax analysis. Then, in step S102, pronunciations are assigned to the speech message. The result of language analysis in step S101 is used in assigning pronunciations. Then, in step S103, prosody data of synthesized speech is generated, based on the pronunciations assigned in step S102. Then, in step S104, a speech waveform is generated, based on the data from the steps described above. The text to speech synthesis is performed in the process described above.

Figure 6:
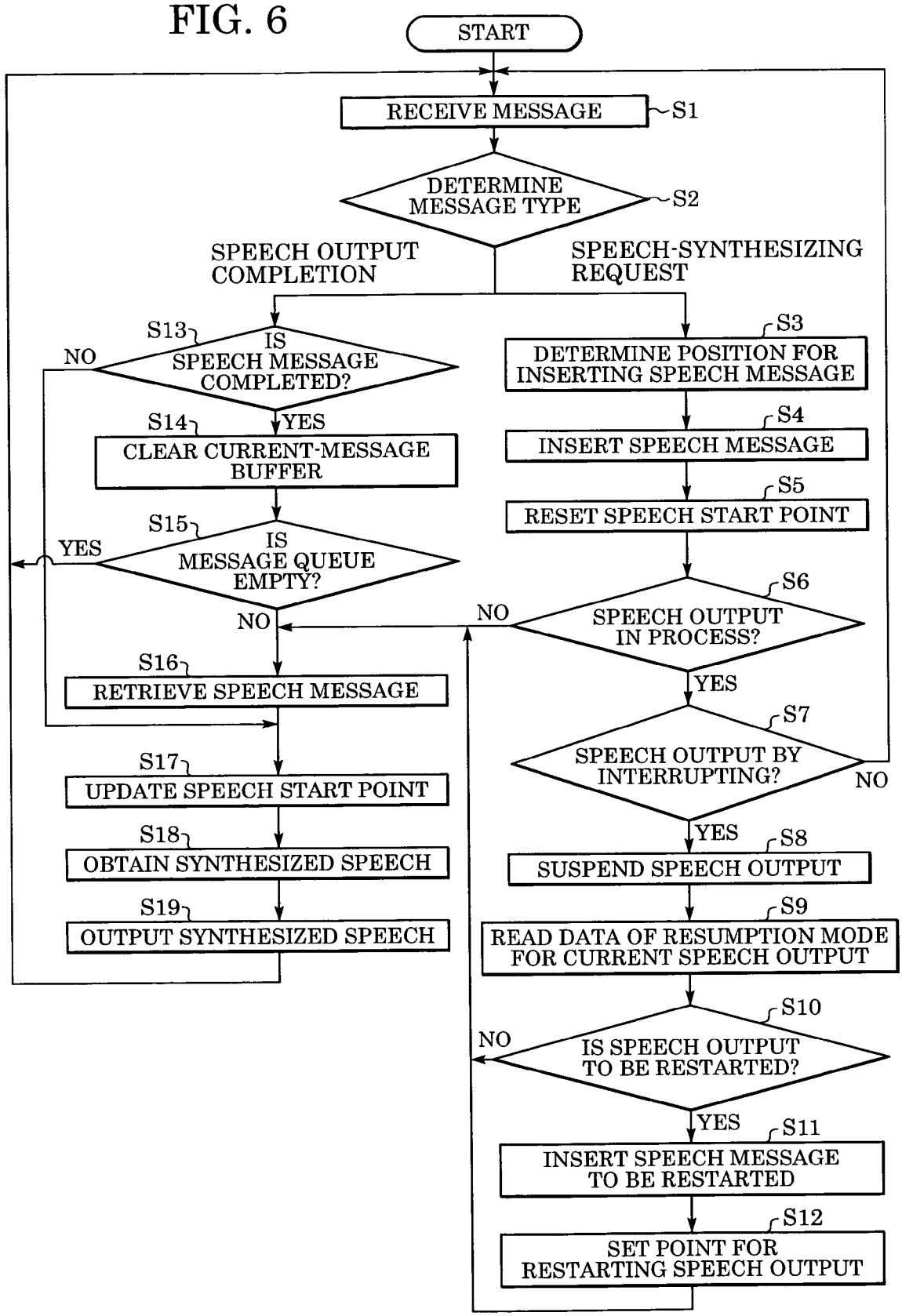
FIG. 6 is a flowchart showing the process of a speech-synthesizing task according to embodiments.

As described in FIG. 6, the speech message is not synthesized and output all at once in the process of obtaining the synthesized speech in step S18 and the process of outputting the synthesized speech in step S19. That is to say, the process shown in FIG. 7 is performed in a phased approach in practice. User discretion is allowed in setting the phases.

For example, steps S101 and S102 may be performed in advance, and steps S103 and S104 may be performed on demand. Alternatively, the entire waveform (speech data) may be generated all at once, and the generated speech data may be partially extracted as necessary.

In the arrangement described above, a speech message can be specified together with the resumption mode of the speech message when the speech message is interrupted by another speech message. Thus, the resumption mode of interrupted speech output can be appropriately controlled.

Second Embodiment

In the first embodiment, the resumption mode is set to "from beginning" or "from suspended point". Alternatively, the resumption mode may be set to "from last word boundary" or "from last phrase boundary". This is because data of word boundaries, phrase boundaries, and the like can be obtained in the language analysis in the text to speech synthesis, as shown in FIG. 7.

When the resumption mode is set to "from last word boundary" or "from last phrase boundary", as described above, pronunciations of the speech after resumption can be adjusted by reassigning pronunciations. In this way, even when speech output is started from some midpoint of the speech output, the speech output can be flexibly performed with pronunciations corresponding to the situation.

Moreover, the resumption mode may be set up so that speech output is not resumed when the current time is past the time set for the speech output, using data of "time-out" described above in FIG. 5.

Moreover, the resumption mode may be set to "no designation". In this case, the resumption mode is selected by a user instruction or by another method at arbitrary timing.

While the embodiments are concretely described above in detail, the present invention may be embodied in various forms, for example, a system, an apparatus, a method, a program, or a storage medium. Specifically, the present invention may be applied to a system including a plurality of devices or to an apparatus including a device.

The present invention may be implemented by providing to a system or an apparatus, directly or from a remote site, a software program that performs the functions according to the embodiments described above (a program corresponding to the flowcharts of the drawings in the embodiments) and by causing a computer included in the system or in the apparatus to read out and execute the program codes of the provided software program.

Thus, the present invention may be implemented by the program codes, which are installed in the computer to perform the functions according to the present invention by the computer. That is to say, the present invention includes a computer program that performs the functions according to the present invention.

In the case of the program, the present invention may be embodied in various forms, for example, object codes, a program executed by an interpreter, script data provided for an operating system (OS), so long as they have the program functions described above.

Typical recording media for providing the program are floppy disks, hard disks, optical disks, magneto-optical (MO) disks, CD-ROMs, CD-Rs, CD-RWs, magnetic tapes, non-volatile memory cards, ROMS, or DVDs (DVD-ROMs or DVD-Rs).

Moreover, the program may be provided by accessing a home page on the Internet using a browser on a client computer, and then by downloading the computer program according to the present invention as is or a file that is generated by compressing the computer program and that has an automatic installation function from the home page to a recording medium, for example, a hard disk. Moreover, the program may be provided by dividing the program codes constituting the program according to the present invention into a plurality of files and then by downloading the respective files from different home pages. That is to say, an Internet server that allows a plurality of users to download the program files for performing the functions according to the present invention on a computer is also included in the scope of the present invention.

Moreover, the program according to the present invention may be encoded and stored in a storage medium, for example, a CD-ROM, and distributed to users. Then, users who satisfy predetermined conditions may download key information for decoding from a home page through the Internet, and the encoded program may be decoded using the key information and installed in a computer to realize the present invention. Moreover, other than the case where the program is read out and executed by a computer to perform the functions according to the embodiments described above, for example, an OS operating on a computer may execute some or all of the actual processing to perform the functions according to the embodiments described above, based on instructions from the program.

Moreover, the program read out from a recording medium may be written to a memory included in, for example, a function expansion board inserted in a computer or a function expansion unit connected to a computer. Then, for example, a CPU included in the function expansion board, the function expansion unit, or the like may execute some or all of the actual processing to perform the functions according to the embodiments described above, based on instructions from the program.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Application No. 2004-246813 filed Aug. 26, 2004, which is hereby incorporated by reference herein in its entirety.

What is claimed is:

1. A method for synthesizing speech by a speech synthesizing apparatus, the method comprising:

using a processor to perform the following:

an obtaining step of obtaining a speech message, wherein resumption data is stored in association with the speech message;

an outputting step of outputting synthesized speech corresponding to the speech message via the speech synthesizing apparatus;

a suspending step of suspending the outputting of the synthesized speech corresponding to the speech message;

a selecting step of selecting, based on the resumption data stored in association with the speech message whose outputting is suspended in the suspending step, a resumption manner from among a plurality of resumption manners, the plurality of resumption manners including at least 1) a manner in which the outputting of the synthesized speech is resumed from the beginning, 2) a manner in which a part of the synthesized speech which has not yet been output is output, and 3) a manner in which the outputting of the synthesized speech is not resumed; and a resuming step of resuming the outputting of the suspended synthesized speech via the speech synthesizing apparatus according to the selected manner.

2. The method according to claim 1, further comprising a registering step of registering the speech message, the corresponding resumption data, and the relationship between the speech message and the corresponding resumption data, in a memory as the registration data.

3. A storage medium encoded with a computer program, the computer program causing a computer to execute the method of claim 1.

4. The method according to claim 1, wherein the suspending step of suspending outputting of the synthesized speech corresponding to the speech message is performed in response to a request for speech output of another speech message.

5. The method according to claim 4, wherein the suspending step of suspending outputting of the synthesized speech corresponding to the speech message is performed when a priority level of the speech message is lower than a priority level of the other speech message, and the suspending step of suspending outputting of the synthesized speech corresponding to the speech message is not performed when the priority level of the speech message is higher than the priority level of the other speech message.

6. The method according to claim 1, wherein the resumption data stored in association with the speech message includes a degree of importance of the speech message, and wherein in the selecting step, the resumption manner for resuming the outputting of the suspended synthesized speech is selected according to the stored degree of importance of the speech message.

7. The method according to claim 6, wherein the degree of importance of the speech message is either a first degree of importance, a second degree of importance or a third degree of importance, with the second degree of importance being lower than the first degree of importance but higher than a third degree of importance, and wherein when the speech message has the first degree of importance, the selecting step selects the resumption manner (1) wherein outputting of the synthesized speech is resumed from the beginning, when the speech message has the second degree of importance, the selecting step selects the resumption manner (2) wherein outputting of the synthesized speech is resumed in the manner in which the part of the synthesized speech which has not yet been output is output, and when the speech message has the third degree of importance, the selecting step selects the resumption manner (3) such that outputting of the synthesized speech is not resumed.

8. An apparatus for synthesizing speech comprising:

an obtaining unit configured to obtain a speech message, wherein resumption data is stored in association with the speech message;

an outputting unit configured to output synthesized speech corresponding to the speech message;

a suspending unit configured to suspend outputting of the synthesized speech corresponding to the speech message;

a selection unit configured to select, based on the resumption data stored in association with the speech message whose outputting is suspended by the suspending unit, a resumption manner from among a plurality of resumption manners, the plurality of resumption manners including at least 1) a manner in which the outputting of the synthesized speech is resumed from the beginning, 2) a manner in which a part of the synthesized speech which has not yet been output is output, and 3) a manner in which the outputting of the synthesized speech is not resumed; and a resuming unit configured to resume outputting of the suspended synthesized speech according to the selected manner.

9. The apparatus according to claim 8, further comprising a registering unit configured to register the speech message, the corresponding resumption data, and the relationship between the speech message and the corresponding resumption data, in a memory as the registration data.

10. The apparatus according to claim 8, wherein the suspending unit is configured to suspend outputting of the synthesized speech corresponding to the speech message in response to a request for speech output of another speech message.

11. The apparatus according to claim 10, wherein the suspending unit is configured to suspend outputting of the synthesized speech corresponding to the speech message when a priority level of the speech message is lower than a priority level of the other speech message, and wherein the suspending unit is configured not to suspend outputting of the synthesized speech corresponding to the speech message when the priority level of the speech message is higher than the priority level of the other speech message.

12. The apparatus according to claim 8, wherein the resumption data stored in association with the speech message includes a degree of importance of the speech message, and wherein the selection unit is configured to select the resumption manner for resuming the outputting of the suspended synthesized speech according to the stored degree of importance of the speech message.

13. The method according to claim 12, wherein the degree of importance of the speech message corresponds to one of a first degree of importance, a second degree of importance, or a third degree of importance, with the second degree of importance being lower than the first degree of importance but higher than a third degree of importance, and wherein when the speech message has the first degree of importance, the selection unit is configured to select the resumption manner (1) wherein outputting of the synthesized speech is resumed from the beginning, when the speech message has the second degree of importance, the selection unit is configured to select the resumption manner (2) wherein outputting of the synthesized speech is resumed in the manner in which the part of the synthesized speech which has not yet been output is output, and when the speech message has the third degree of importance, the selection unit is configured to select the resumption manner (3) such that outputting of the synthesized speech is not resumed.

* * * * *